United States Patent [19]

Smith

[11] 4,064,590

[45] Dec. 27, 1977

[54] TOP GUIDE PIVOT FOR BIFOLD DOORS

[76] Inventor: Lester L. Smith, 5151 Mission Hill Drive, Tucson, Ariz.

[21] Appl. No.: 702,225

[22] Filed: July 2, 1976

[51] Int. Cl.[2] ..... E05D 13/02

[52] U.S. Cl. ..... 16/90; 160/118; 160/206; 403/146

[58] Field of Search ..... 16/90, 87 R, 94 R, 96 R, 16/103, 104, 188, 189; 160/118, 183, 199, 206; 403/146, 148, 149, 166

[56] References Cited

U.S. PATENT DOCUMENTS

| | | | |
|---|---|---|---|
| 3,022,818 | 2/1962 | Rolfe | 160/206 |
| 3,045,746 | 7/1962 | Kummerman | 160/206 |
| 3,181,596 | 5/1965 | Winnan et al. | 160/118 X |
| 3,206,999 | 9/1965 | Roth | 403/166 X |
| 3,345,711 | 10/1967 | McCarthy | 403/166 X |
| 3,494,408 | 2/1970 | D'Ercole | 160/118 X |
| 3,640,496 | 2/1972 | Duncan | 16/42 X |
| 3,813,730 | 6/1974 | Smith | 16/135 |
| 3,907,021 | 9/1975 | Smith | 160/118 |

FOREIGN PATENT DOCUMENTS

| | | | |
|---|---|---|---|
| 2,322,666 | 12/1973 | Germany | 160/199 |

*Primary Examiner*—Werner H. Schroeder
*Assistant Examiner*—Moshe I. Cohen
*Attorney, Agent, or Firm*—McCaleb, Lucas & Brugman

[57] ABSTRACT

An assembly for guiding movements of the non-pivotally supported one of a pair of hingedly interjoined bifolding panels, or the like, laterally across a door opening which includes a main body non-rotatably anchored in a mounting socket therefor bored inwardly of the upper or top edge of the one guide panel and including a vertically biased, laterally offset track engaging guide means cooperative with an overhead guide track such that the line of engagement between such offset guide means and the track is in proximity to the free or unhinged lateral edge of the guide panel whereby to increase opening movement of the panels and avoid binding between the track and guide means.

6 Claims, 7 Drawing Figures

Fig. 1.
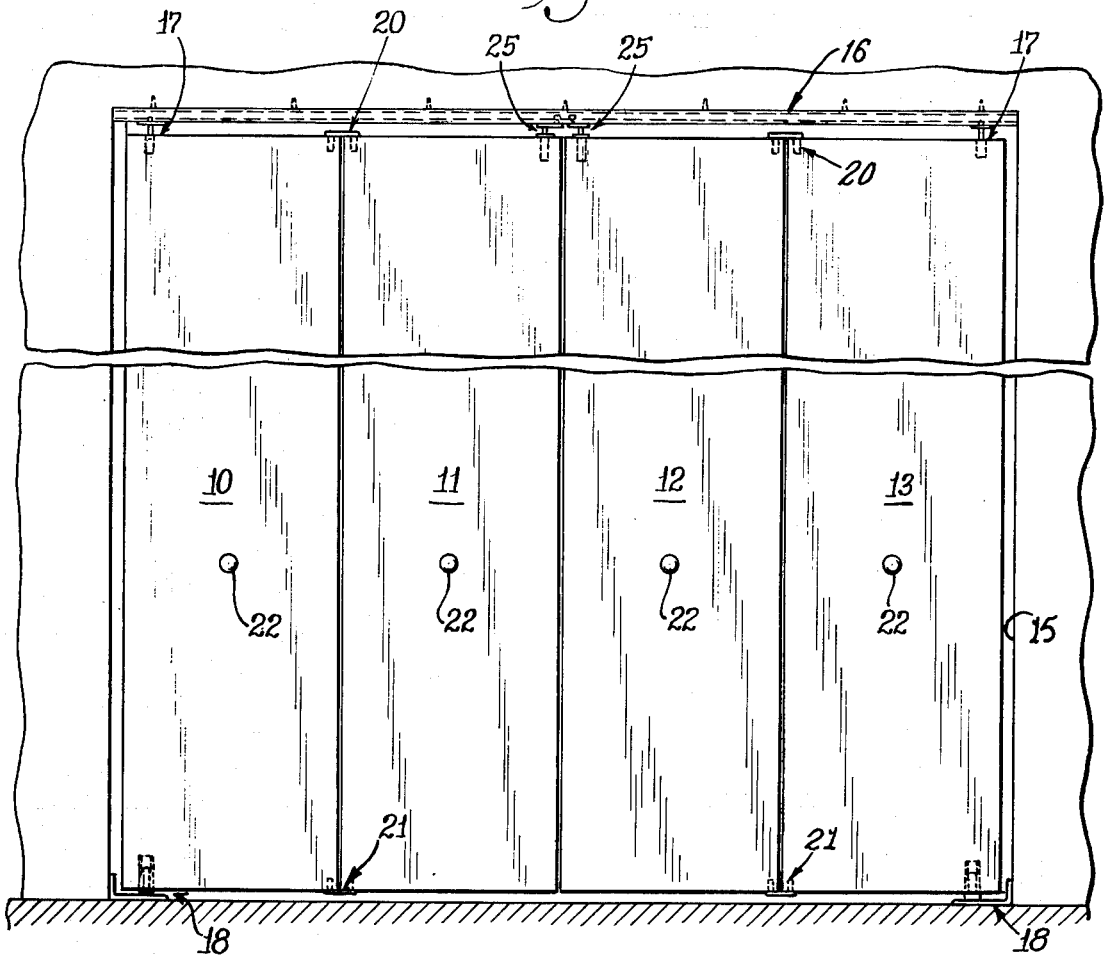
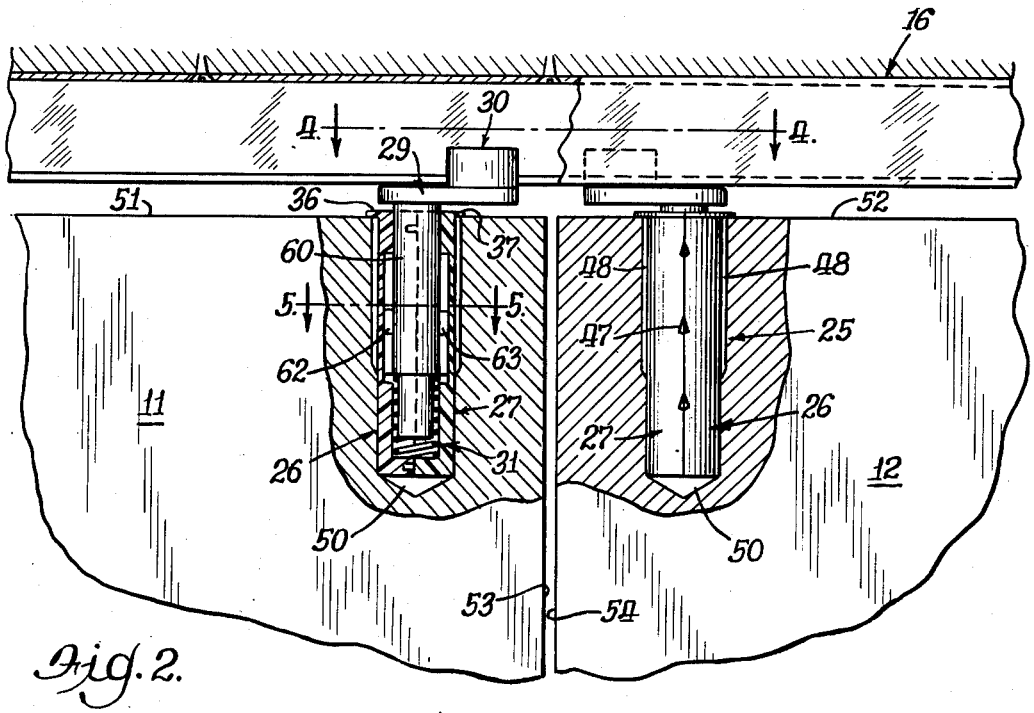
Fig. 2.

TOP GUIDE PIVOT FOR BIFOLD DOORS

BACKGROUND OF THE INVENTION

This invention relates generally to door hardware and more particularly to improved top guide pivot means for bifolding doors or panels.

The typical prior art top guide means for guiding a pair of bifolding doors or panels laterally across a door opening employs a track engaging pin or roller extending upwardly from the top edge of a non-jamb mounted guide panel of a hingedly joined pair of panels in such fashion that the open positioning of the panels is limited to one of substantially right angles with respect to the guide track. Consequently, the door opening is partially obstructed by the open door panels, thus diminishing full access through the doorway. This is particularly undesirable when the bifolding doors are utilized to close over a closet door opening, for example, where full access to the closet interior is desirable. This limitation on the operational use of bifolding door installations is particularly prevalent when employing hardware of the type described in my U.S. Pat. No. 3,813,730, issued June 4, 1974, for example, wherein the door supporting pivots and track guides are associated with socket mounted anchor means as opposed to more conventional screw fastener mounting. In such socket mounted hardware the mounting sockets are bored inwardly of the end edges of the panels, and because of the desirability of utilizing the panels interchangeably for both left and right-hand door installations, it is the practice to locate the axes of the anchor sockets at uniform distances from the lateral panel edges. Preferably the socket boring operation is carried out in a factory context by large jig boring machines with the hardware being installed either at the factory or the jobsite. Within the aforenoted parameters of practice, it will be understood that the pivot axes for the pivotally supported panels and the axis of the track guide rollers or pins on the non-pivotally supported guide panels are normally located like distances from the lateral door margins or edges. That being the case, the geometrics of the door folding or opening operations are such that the open position angle of the door panels, that is, when the doors are in fully opened condition, is restricted to one of substantially right angles with respect to the overhead guide track. As pointed out above, this restriction seriously limits full acess to the door opening.

Ancillary to the above, is the further problem attending closing operation of the door panels. Briefly, it is typical practice for the user to apply pressure to the jamb or pivot mounted panel to initiate door closing movements and in fact operating handles or knobs are oftentimes provided on such panels for that very purpose. However when the guided door panel is positioned at right angles or near right angles to the door track, closing pressure applied to the pivoted panel oftentimes causes the guide pivot to bind in the track, thereby preventing or hampering smooth door closing movements. Of additional importance in this respect is the attendant possibility of seriously damaging and bending the pivot hardware or dislocating the pivot axis from its adjusted location. All this leads to eventual breakdown and loss of smooth operational functioning for the door installation.

SUMMARY OF THE PREFERRED EMBODIMENT

In brief, the present invention is directed to the alleviation of the above noted problems and difficulties encountered in utilizing presently known bifold door hardware and particularly, is directed to an improved track guided roller or top guide pivot for regulating and guiding movements of the non-pivoted guide panels in a bifold panel installation. More particularly, this invention embodies structure adopting the concept of offsetting the axis or line of engagement between the top guide means and its guide track from the axis of its associated anchor means. Consequently, the ability to uniformly drill or bore door panels for either right or left-hand installations when utilizing socket mounted hardware for both door pivots and guides is achieved. In order to accomplish and carry out these features, the preferred embodiment of the present invention comprises anchor means insertable into a mounting socket bored inwardly of the upper or top edge of a track guided panel and from which extends a track engaging guide means having an axis or line of engagement with the track which is laterally offset from the axis of its associated mounting socket; such line of engagement being located closely adjacent the free or unhinged lateral edge of the guide panel. As a consequence, open positioning of a pair of hingedly connected bifold door panels equipped with a guided assembly of this invention is one of obtuse angularity with respect to the track and the guide panel is prevented from assuming a right angular or near right angular position with respect to the guide track.

Among the important objects of this invention is the provision of a new and improved top guide pivot assembly for bifold doors.

Another important object of this invention is to provide a top guide pivot for bifolding doors which affords wider door opening angles.

Still another important object of this invention is to provide a top guide pivot for bifold door assemblies wherein binding of the guide pivot and track by application of closing forces against a pivot supported panel is avoided.

Still another object of this invention is to provide an improved top guide assembly for track guided bifold doors and the like employing socket mounted anchor means and laterally offset track engaging guide means whereby a track guided panel is fully interchangeable with a pivot supported panel employing socket mounted pivot hardware.

Having thus described the present invention, the above and further objects, features and advantages thereof will be apparent to those skilled in this art from the following detailed description of a preferred embodiment thereof illustrated in the accompanying drawings and constituting the best mode presently contemplated for enabling those skilled in the art to practice this invention.

In the drawings:

FIG. 1 is a front elevational view of a typical bifold door installation employing the guide assembly of this invention;

FIG. 2 is an enlarged partial front elevational view with portions thereof broken away in section, illustrating the improved guide assembly of this invention;

Figure 3:
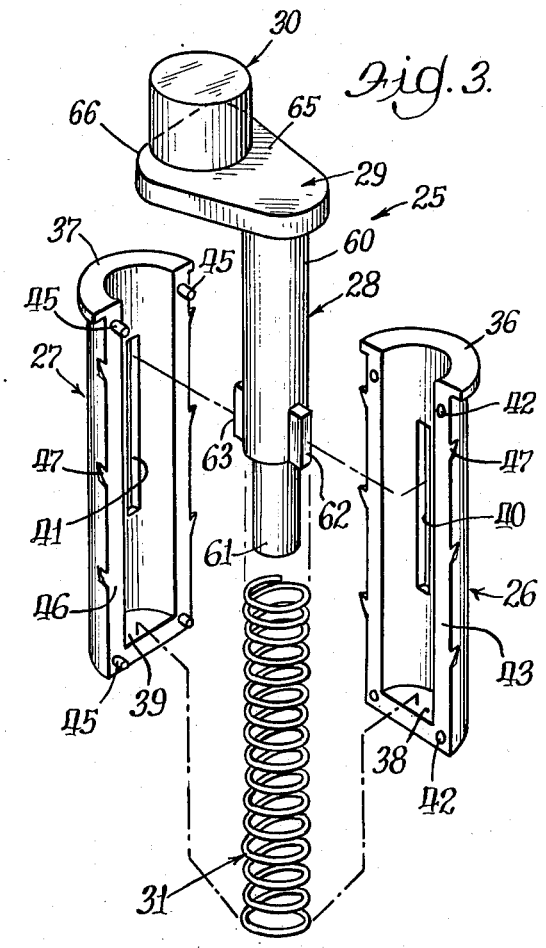
FIG. 3 is an exploded perspective view of the operational elements embodied in the guide assembly illustrated in FIG. 2.
Figure 4:
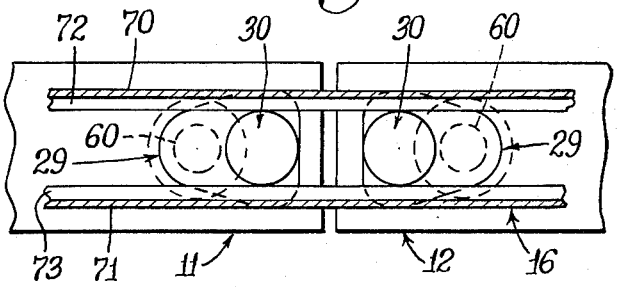
FIG. 4 is a sectional view taken substantially along vantage line 4—4 of FIG. 2 and looking in the direction of the arrows thereon.
Figure 5:
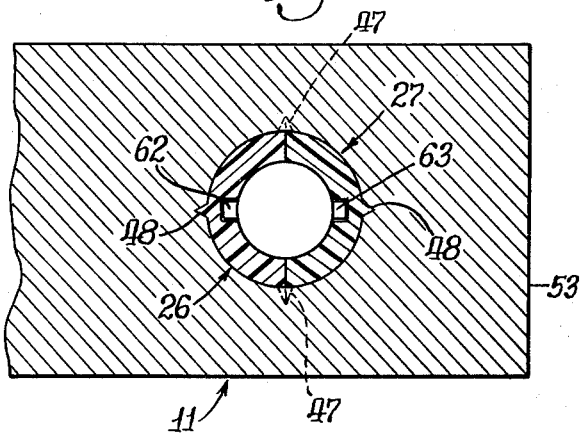
FIG. 5 is a cross-sectional view taken substantially along vantage line 5—5 of FIG. 2 and looking in the direction of the arrows thereon.
Figure 6:
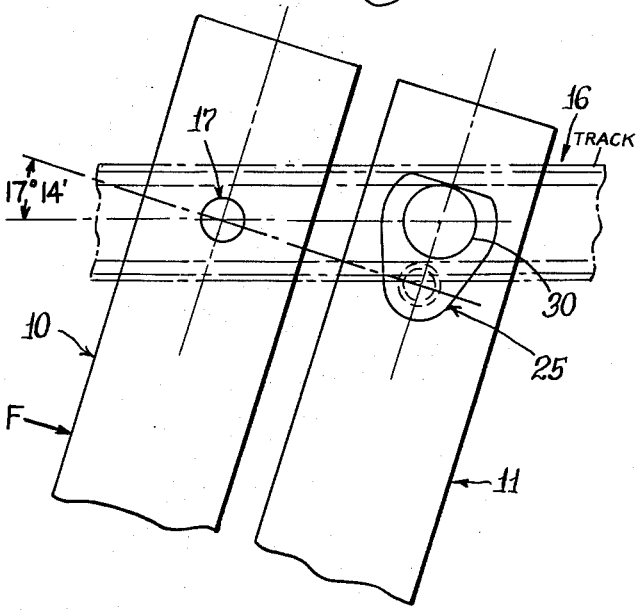
FIGS. 6 and 6A are corresponding schematic views in top plan illustrating the open position for a pair of bifolding panels equipped with the guide means of this invention and the prior art, respectively.
Figure 6A:
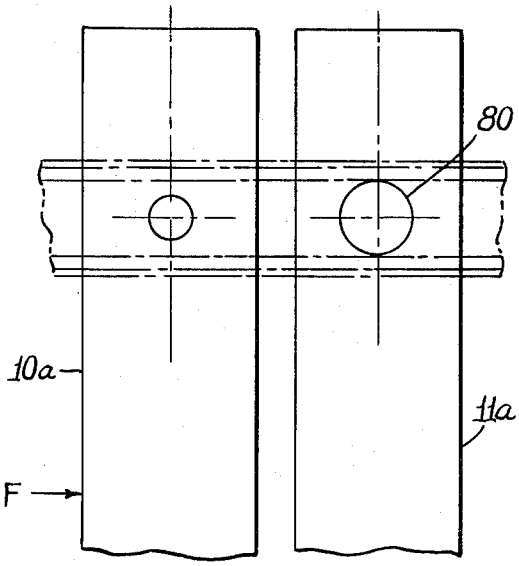

Turning now to the specifics of the preferred embodiment illustrated in the accompanying drawings, it will be recognized from FIG. 1 that the typical four-panel bifolding door installation therein illustrated comprises left and right-hand pairs of panels 10–13 mounted for folding movement across door opening 15 bounded by a horizontal undersupport or floor, vertically extending side jamb members and an overhead lintel according to conventional construction practice. A guide track 16 extends across the upper reaches of the door opening and is supported on the overhead lintel immediately above the upper ends of the door panels. In the particular four panel installation illustrated, the outboard panels 10 and 13 are pivotally supported adjacent the vertical door jambs by top and bottom pivot assemblies 17 and 18, according to conventional practice. Panels 10 and 13 are respectively joined to one of the inboard panels 11 and 12 by hinge assemblies 20 and 21 mounted between opposing lateral edges thereof whereby the panels of such pairs are adapted for hinging or folding movements relative to each other. Each of several panels is provided with a manually engageable knob means 22 for applying opening and closing forces to the doors and each of the inboard or non-pivotally supported guide panels 11 and 12 is provided with a top guide pivot assembly 25 engageable with the track means 16. For more detailed particulars of the illustrated socket mounted hardware, especially the top and bottom pivot assemblies and hinge means illustrated, reference may be made to my above noted U.S. Pat. No. 3,813,730.

Inasmuch as the current invention does not depend on the particulars of either the hinge means or door supporting pivot means employed therewith, the features thereof will not be detailed further herein and the description which follows will be directed more to the improved guide pivot means 25. Further, it is to be understood that while the illustration of FIG. 1 depicts a typical four panel door installation, the present invention is equally applicable to two panel installations and that while its preferable use is in conjunction with socket mounted pivot and hinge hardware of the type illustrated in FIG. 1 and more particularly described in my aforenoted U.S. Pat. No. 3,813,730 or similar systems, it is also useful with other styles of pivot and hinge assemblies, such as screw mounted assemblies.

Turning now to the specifics and structural details of the guide means 25, initial reference is made to FIGS. 2–5 of the drawings wherein its elemental aspects and combination are fully set forth. As best shown in FIGS. 2 and 3, for example, assembly 25 comprises a bipart anchor housing or body made up of mating semi-cylindrical half body portions 26 and 27, a plunger member 28 housed within the assembled portions 26 and 27 and having a laterally extending platform portion 29 at its upper end carrying a guide pivot 30 in offset alignment from the axis of the plunger body. Biasing means 31, comprising a coil spring member, engages plunger 28 to urge the guide pivot into engagement with the track 16 as will appear presently.

With particular reference to the anchor body portions 26 and 27, it will be recognized that each is formed as a generally elongated, semi-cylindrical member having a semi-circular external collar portion 36 and 37, respectively, at one outer or operationally upper end thereof. The opposite or inner end of each portion 26 and 27 is enclosed respectively by a semi-cylindrical bottom end wall 38, 39. Each of the portions 26 and 27 is formed with an elongated rectangular shaped recessed guide channel 40, 41, respectively, in its interior side wall, which channels are aligned in opposing registration on diametrically opposite side of the anchor housing when the two body portions thereof are assembled.

The female body portion 26 is provided with plural pin sockets 42 located adjacent its collar portion 36 and bottom wall 38 and formed inwardly of the mating face or edge wall 43 thereof. Correspondingly male body portion 27 is equipped with outwardly projecting pins 45 on its mating edge wall 46. In assembly the pins 45 are inserted into the sockets 42 to interlock the two body portions and form a generally cylindrical housing. It is further to be noted that each of the portions 26 and 27 is equipped with a plurality of outwardly extending half-barb portions 47, 47 which intermate in assembly to provide rows of exterior anchor barbs at the junction of the mating surfaces 43 and 46. In addition (see FIG. 2) each of body portions 26 and 27 is preferably provided with a longitudinally extended guide rib 48 which align in diametrically opposed relation on opposite sides of the assembled anchor housing and intermediate the rows of anchor barbs.

As best illustrated in FIG. 2 of the drawings, the anchor housing is adapted for insertion into an anchor socket 50 bored inwardly of the upper or top edges 51 and 52 of the guide panels 11 and 12, respectively, and respectively spaced inwardly of the lateral or free edges 53 and 54 thereof. It is to be noted that the upper end collar portions 36 and 37 of the assembled anchor housing abut the top edges 51 and 52 of the associated door panels and that the assembled barb portions 47, 47 thereof are reversely slanted to permit insertion, but oppose withdrawal of an anchor body from its anchor socket. The guide rib portions 48, 48 function as anti-rotational obstructions to prevent rotational movement of the anchor body within the socket 50.

The plunger member 28, as best illustrated in FIG. 3, comprises a main cylindrical body portion 60 having a radially inset or diametrically reduced spring guide portion 61 at its lower end for coaxial reception of the upper end of compression spring means 31 thereabout in assembly. Immediately adjacent the reduced portion 61 are a pair of diametrically opposed rectangular parallelepiped guide ears 62, 63 adapted for guiding reception in the opposing slotted recesses 40 and 41 of the assembled body portions of the anchor housing, the lengthwise limits of such recesses 40, 41 determining the limits of rectilinear movement of the plunger body 60 within the anchor housing. Operationally, spring means 31 normally urges the plunger body 60 outwardly of the anchor housing while permitting its resilient movement inwardly thereof as required by following movements of the guide means along the overhead track 16. In this regard, it is fully contemplated that the spring means known top guide pivots and further will understand that while the present invention has been described in association with a particular preferred embodiment illustrated in the accompanying drawings, it is intended that the same be susceptible to variation and substitution of equivalents except as may be limited by the following appended claims.

I claim:

1. In a bifolding door installation having a pair of rectangular shaped door panels hingedly interjoined at adjacently opposed first lateral edges thereof and vertically mounted in a door opening for horizontal folding movements thereacross, a first panel thereof being supported adjacent its second lateral edge for pivotal movement about a vertical axis and the second panel thereof being guided adjacent its second lateral edge for movement along an elongated guide track mounted across the upper end of the door opening and characterized by a channel opening along the underside thereof, a top guide assembly for coupling the second panel to the guide track comprising: a generally cylindrical housing insertable in a mounting socket therefor extending inwardly of the top edge of the second panel and adjacently parallel with the second lateral edge thereof, a plunger extending axially outwardly of one end of said housing, a platform portion affixed to and extending laterally from the outer end of said plunger, and track engagable guide means projecting from said platform portion in spaced parallelism with said plunger and housing; the assembly being operationally associated with said second panel to maintain said guide means substantially opposite the intersection of said top and second lateral edges thereof and oriented for entry into the channel opening of the guide track whereby to maintain said second lateral edge of said second panel aligned beneath said channel opening throughout opening and closing movements of the pair of panels.

2. The combination of claim 1 wherein said housing includes external tang and rib means operable to prevent axial withdrawal and rotation of said housing in said mounting socket.

3. The combination of claim 1 wherein said guide means and plunger are formed integrally with said platform portion and extend from opposite sides of and at right angles to the lengthwise axis thereof.

4. The combination of claim 1 wherein the plunger is non-rotatably journaled in said housing for limited coaxial movement relative thereto.

5. The combination of claim 4 and spring means associated with said plunger to normally bias the same outwardly of said housing.

6. The combination of claim 4 wherein said housing is of bipart construction and is formed with a cylindrical interior chamber having a pair of diametrically opposed elongated slotted recesses in the walls thereof, and said plunger comprises a pair of diametrically opposed outwardly extending ear portions receptive in said slotted recesses thereby to prevent rotational movement of said plunger in said housing while affording limited axial movement thereof.

* * * * *